US009976833B2

(12) United States Patent
Hines

(10) Patent No.: US 9,976,833 B2
(45) Date of Patent: May 22, 2018

(54) PICATINNY MOUNTABLE BAYONETS

(71) Applicant: Falcon Industries, Inc., Edgewood, NM (US)

(72) Inventor: Stephen Charles Hines, Edgewood, NM (US)

( * ) Notice: Subject to any disclaimer, the term of this patent is extended or adjusted under 35 U.S.C. 154(b) by 0 days. days.

(21) Appl. No.: 15/267,505

(22) Filed: Sep. 16, 2016

(65) Prior Publication Data

US 2017/0227323 A1 Aug. 10, 2017

Related U.S. Application Data

(60) Provisional application No. 62/219,391, filed on Sep. 16, 2015, provisional application No. 62/394,428, filed on Sep. 14, 2016.

(51) Int. Cl.
*F41C 27/18* (2006.01)
*F41G 11/00* (2006.01)

(52) U.S. Cl.
CPC ..... *F41C 27/18* (2013.01); *F41G 11/003* (2013.01)

(58) Field of Classification Search
CPC ..... F41C 27/18
See application file for complete search history.

(56) References Cited

U.S. PATENT DOCUMENTS 4,821,356 A 4/1989 Finn
5,594,967 A 1/1997 Morton et al.
6,994,449 B2 2/2006 Kim
D530,774 S * 10/2006 Oscarsson ..... D22/108
D610,223 S * 2/2010 Moore ..... D22/108
9,341,442 B1 * 5/2016 Geissele ..... F41C 27/18
9,599,432 B2 * 3/2017 Neville ..... F41C 27/18
9,618,299 B1 * 4/2017 Gingrich ..... F41C 27/18
2016/0327372 A1 * 11/2016 Schrock ..... F41G 11/003

OTHER PUBLICATIONS

Military Standard, Dimensioning of Accessory Mountain Rail for Small Arms Weapons, MIL-STD-1913 (AR), Feb. 3, 1995, 11 pages.
Welcome to the M9 Bayonet Library, M9Bayonet.com, 5 pages.
Operator's Manual, Multi Purpose Bayonet System (MPBS), M9 (1005-01-227-1739), 11 pages.
Technical Manual, Organizational and Direct Support Maintenance Manual (Including Repair Parts and Special Tools List), Jan. 11, 1993, 102 pages.

* cited by examiner

*Primary Examiner* — Gabriel Klein
(74) *Attorney, Agent, or Firm* — Richard Krukar

(57) ABSTRACT

A bayonet mounting fixture can adapt a rifle having a mounting rail to also have a bayonet mount. Previously, bayonets were often mounted to a firearm by passing the barrel through a hole in the guard and then attaching the rear end of the bayonet to a bayonet mount or mounting lug further back. The bayonet mounting fixture can have a forward mount and a rear mount attached to the mounting rail. The forward mount has a round piece that can go inside the hole in the bayonet's guard. The rear mount can have a mounting lug to which the rear end of the bayonet is attached.

15 Claims, 10 Drawing Sheets

PICATINNY MOUNTABLE BAYONETS

RELATED APPLICATIONS

This application claims the benefit and priority of U.S. Provisional Application 62/394,428, filed Sep. 14, 2016, titled "Picatinny Mountable Bayonets" and U.S. Provisional Application 62/219,391, filed Sep. 16, 2015, titled "Picatinny Mountable Bayonets." U.S. Provisional Applications 62/394,428 and 62/219,391 are herein incorporated by reference in their entirety.

TECHNICAL FIELD

Embodiments are related to bayonets and to mounting rails for firearms.

BACKGROUND

A bayonet is, essentially, a dagger or knife that can be attached to the muzzle end of a firearm. In their more recent forms, bayonets have holes in their guards and latch plates at their butt ends. A rifle configured for bayonet mounting typically has a bayonet mount permanently attached to the rifle barrel. A soldier can "fix bayonet" to a rifle by sliding the rifle barrel through the hole in the bayonet guard and latching the bayonet latch plate to the rifle's bayonet mount.

U.S. Pat. No. 4,821,356 titled "MILITARY BAYONET AND SCABBARD" issued to Finn on Apr. 18, 1989 is herein incorporated by reference in its entirety. U.S. Pat. No. 4,821,356 teaches a bayonet having a guard (element 12) with "an integral ring 17 for circling the barrel," a short rectangular tang 22 having a threaded end 23, a tang rod or extension 24, and a latch plate (latching mechanism 14). Beginning at col. 3 line 40, U.S. Pat. No. 4,821,356 describes bayonets in a section title "The Bayonet Generally." It is for these descriptions and its other teachings of bayonets, the parts of bayonets, the construction of bayonets, and the operation of bayonets that U.S. Pat. No. 4,821,356 is herein incorporated by reference in its entirety.

U.S. Pat. No. 5,594,967 titled "BAYONET SYSTEM INCLUDING BAYONET WITH INTEGRAL TANG AND SCABBARD WITH HAND PROTECTION" issued to Morton et al. on Jan. 21, 1997 is herein incorporated by reference in its entirety. U.S. Pat. No. 5,594,967 teaches a bayonet having a guard 58 with attachment bore 62 that "fits over the barrel of the rifle," an integral tang 30 that is part of a single piece blade-and-tang unit 26, and a latch assembly 80. In addition, U.S. Pat. No. 5,594,967 provides extensive instruction on the parts, assembly, and construction of bayonets. Furthermore, U.S. Pat. No. 5,594,967 discusses the US Army M9 bayonet system. It is for its descriptions and its other teachings of bayonets, the parts of bayonets, the construction of bayonets, and the operation of bayonets that U.S. Pat. No. 5,594,967 is herein incorporated by reference in its entirety.

U.S. Provisional Application 62/219,391 titled "Picatinny Mountable Bayonets" filed Sep. 16, 2015 and which is herein incorporated by reference in its entirety disclosed systems and methods for adapting a rail cover equipped firearm to mount bayonets such as military issue bayonets including the US Army M9 bayonet system. U.S. Provisional Application 62/219,391 also discloses systems and methods for producing a knife or bayonet that can be attached directly to a mounting rail. It is for these systems and methods, as well as the others disclosed that U.S. Provisional Application 62/219,391 is herein incorporated by reference in its entirety.

Current bayonet systems predominantly attach to a rifle by passing the rifle barrel through a hole in the guard and attaching a latch plate or latch mechanism to a bayonet mount that is welded to or otherwise permanently attached to the rifle barrel. Current firearms often lack the bayonet mount and often have handguards that extend nearly the entire length of the barrel. Improved systems and methods for attaching bayonets to current firearms are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

It is, therefore, an aspect of the embodiments that a bayonet mounting fixture can be attached to the mounting rail of a firearm and that a bayonet can be attached to the bayonet mounting fixture to thereby "fix bayonet" to the firearm. It is understood that modern firearms are often provided with mounting rails, such as the well-known Picatinny rail, for mounting firearm accessories to the firearm.

The bayonet mounting fixture can have a forward mount and a rear mount. Some embodiments can have the forward and rear mounts as distinct and separate pieces while other embodiments can have a bridge joining the front and rear mounts. The bridge, if it is present, can also engage the mounting rail to prevent the bridge from being pulled away from the mounting rail. The rear mount has a rear clamp and a mounting lug while the forward mount has a front clamp and a round piece. The rear mount can be formed as a single piece or the mounting lug can be joined to or attached to the rear clamp. The forward mount can be formed as a single piece or the round piece can be joined to or attached to the rear clamp. The forward mount can be attached to the mounting rail by clamping the forward clamp onto the mounting rail. The rear mount can be attached to the mounting rail by clamping the rear clamp onto the mounting rail.

Recall that bayonets can be attached to prior art firearms by passing the rifle barrel into the bayonet's attachment bore and then attaching the bayonet's latching mechanism to the firearm's bayonet mount. It is another aspect of the embodiments that a bayonet can be attached to the forward mount and the rear mount by passing the forward mount's round piece into the bayonets attachment bore and then attaching the bayonet's latching mechanism to the rear mount's mounting lug.

It is yet another aspect of the embodiments that the forward clamp comprises a forward clamp body and a forward jaw. The forward clamp body can comprise the round piece, the pieces being either formed as a single piece or otherwise attached. The forward jaw can be tightened to the forward clamp body to thereby clamp the forward clamp onto the mounting rail. Some embodiments can use a bolt that passes through the forward jaw and into the forward clamp body such that tightening the bolt causes the forward clamp to clamp onto the mounting rail. In those embodiments wherein the mounting rail is a Picatinny rail or similar rail having recoil grooves, the bolt can also pass through a recoil groove to thereby prevent the forward mount from sliding along the mounting rail.

It is still yet another aspect of the embodiments that the rear clamp comprises a rear clamp body and a rear jaw. The rear clamp body can comprise the mounting lug, the pieces being either formed as a single piece or otherwise attached. The rear jaw can be tightened to the rear clamp body to thereby clamp the rear clamp onto the mounting rail. Some embodiments can use a bolt that passes through the rear jaw and into the rear clamp body such that tightening the bolt causes the rear clamp to clamp onto the mounting rail. In those embodiments wherein the mounting rail is a Picatinny rail or similar rail having recoil grooves, the bolt can also pass through a recoil groove to thereby prevent the rear mount from sliding along the mounting rail.

BRIEF DESCRIPTION OF THE DRAWINGS

The accompanying figures, in which like reference numerals refer to identical or functionally similar elements throughout the separate views and which are incorporated in and form a part of the specification, further illustrate the present invention and, together with the background of the invention, brief summary of the invention, and detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof. In general, the figures are not to scale.

A bayonet mounting fixture can adapt a rifle having a mounting rail to also have a bayonet mount. Previously, bayonets were often mounted to a firearm by passing the barrel through a hole in the guard and then attaching the rear end of the bayonet to a bayonet mount or mounting lug further back. The bayonet mounting fixture can have a forward mount and a rear mount attached to the mounting rail. The forward mount has a round piece that can go inside the hole in the bayonet's guard. The rear mount can have a mounting lug to which the rear end of the bayonet is attached.

Figure 1:
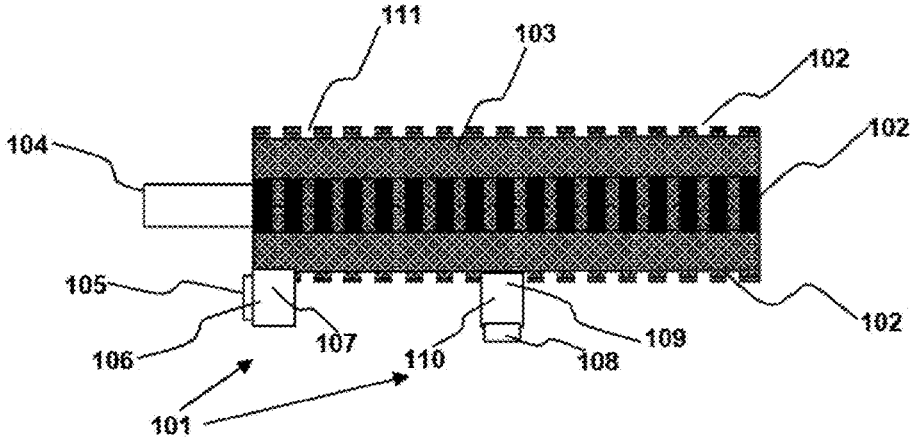
FIG. 1 illustrates a bayonet mounting fixture attached to the mounting rail of a firearm in accordance with aspects of the embodiments.

FIG. 1 illustrates a bayonet mounting fixture 101 attached to the mounting rail 102 of a firearm 104 in accordance with aspects of the embodiments. Note that only the barrel and forward grip 103 of the firearm 104 are visible in FIG. 1. The illustrated forward grip 103 is a quad grip with four mounting rails 102, of which three are visible. The mounting rails 102 are Picatinny style mounting rails with recoil grooves 111. A forward mount 107 has a round piece 105 and a forward clamp 106. A rear mount 110 has a mounting lug 108 and a rear clamp 109.

Figure 2:
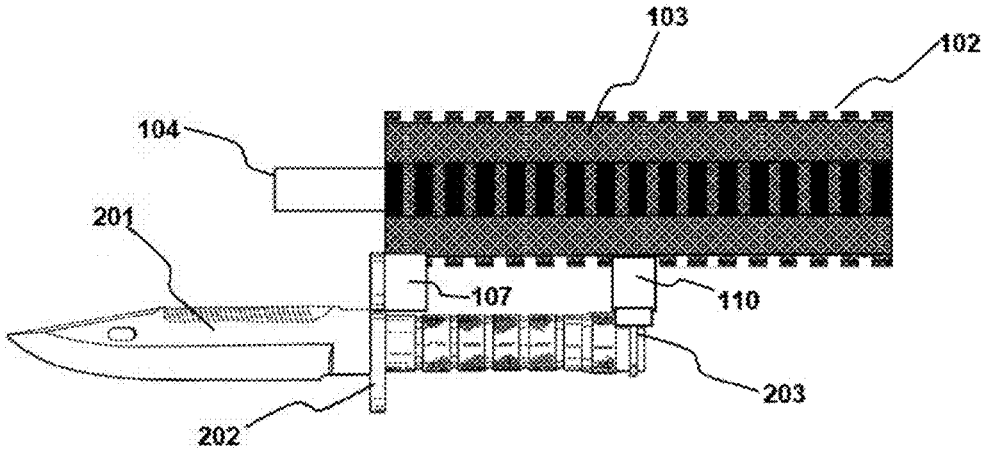
FIG. 2 illustrates a bayonet attached to a bayonet mounting fixture that is attached to the mounting rail of a firearm in accordance with aspects of the embodiments.
Figure 3:
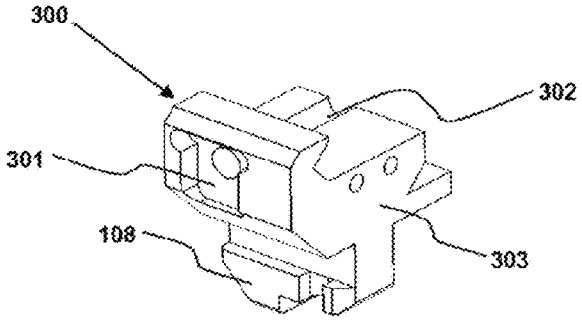
FIG. 3 illustrates a rear clamp assembly in accordance with aspects of the embodiments.
Figure 4:
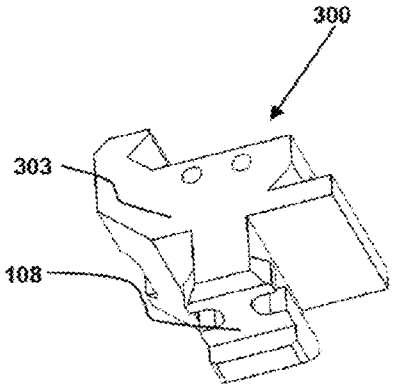
FIG. 4 illustrates a rear clamp assembly in accordance with aspects of the embodiments.
Figure 5:
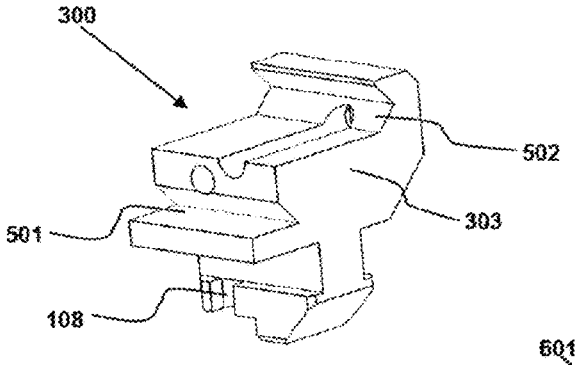
FIG. 5 illustrates a rear clamp assembly in accordance with aspects of the embodiments.
Figure 6:
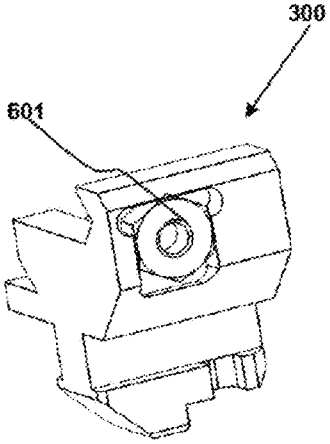
FIG. 6 illustrates a rear clamp assembly with a nut visible in accordance with aspects of the embodiments.

FIG. 2 illustrates a bayonet 201 attached to a bayonet mounting fixture 101 that is attached to the mounting rail 102 of a firearm 104 in accordance with aspects of the embodiments. The illustrated bayonet mounting fixture 101 is the same as that of FIG. 1. The guard 202 of the bayonet 201 is around the round piece 105. The latching mechanism 203 of the bayonet 201 is attached to the mounting lug 108 of the rear mount 110.

FIGS. 3-6 illustrate a rear clamp assembly 300 in accordance with aspects of the embodiments. The illustrated rear clamp assembly 300 has a rear clamp body 303 integrally formed with mounting lug 108. Other embodiments can attach the mounting lug and rear clamp body using other means. The rear clamp body 303 has a nut recess 301 and a bolt groove 302. A nut 601 can fit in the bolt recess 301. A bolt threaded into nut 601 would have its shank and some threads passing along the bolt groove 302. Some embodiments can have a threaded hole instead of the nut 601 and nut recess 301. A jaw groove 501 can interface with a clamp jaw 701 to help guide the clamp jaw into the clamp body as the clamp is tightened. Rail groove 502 engages with the angled sides of a Picatinny rail to prevent the clamp from being pulled from the rail.

Figure 7:
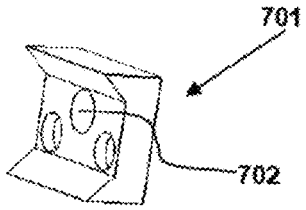
FIG. 7 illustrates a clamp jaw in accordance with aspects of the embodiments.

FIG. 7 illustrates a clamp jaw 701 in accordance with aspects of the embodiments. The clamp jaw 701 has a hole 702 through which the threads and shank of a bolt can pass, as illustrated in FIG. 8.

Figure 8:
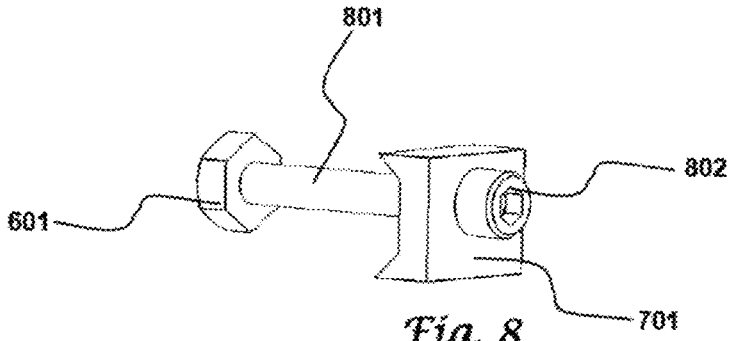
FIG. 8 illustrates a clamp jaw with a nut and bolt in accordance with aspects of the embodiments.

FIG. 8 illustrates a clamp jaw 701 with a nut 601 and bolt 801 in accordance with aspects of the embodiments. The threads and shank of bolt 801 have been passed through hole 702 and nut 601 threaded onto bolt 801. The clamp jaw 701, bolt 801, and nut 601 of FIGS. 7-8 can be used with either the rear mount 110 or forward mount 107 to clamp the mount to the mounting rail.

Figure 9:
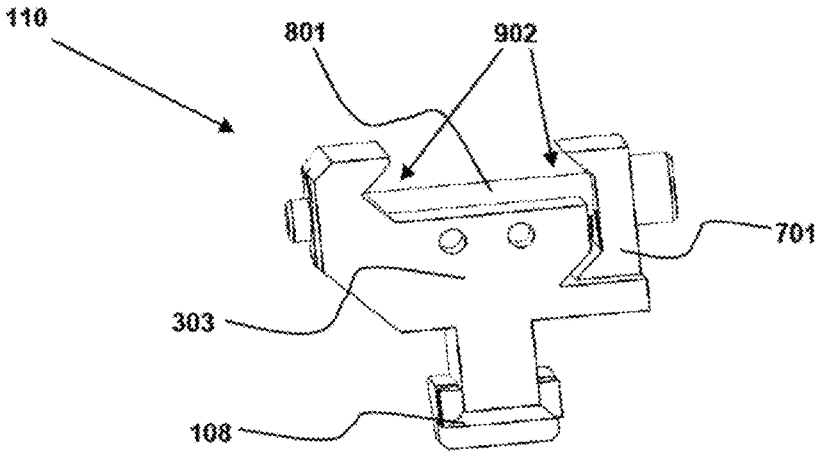
FIG. 9 illustrates a rear mount in accordance with aspects of the embodiments.

FIG. 9 illustrates a rear mount 110 in accordance with aspects of the embodiments. Bolt 801 is installed in clamp jaw 701 and rear clamp body 303 such that tightening bolt 801 causes clamp jaw 701 to tighten into rear clamp body 303. The shank 902 of bolt 801 is shown in bolt groove 302. Without loss of generality, only the unthreaded shank 902 is shown with the understanding that the threads of bolt 801 may also lie with the bolt groove 302.

Figure 10:
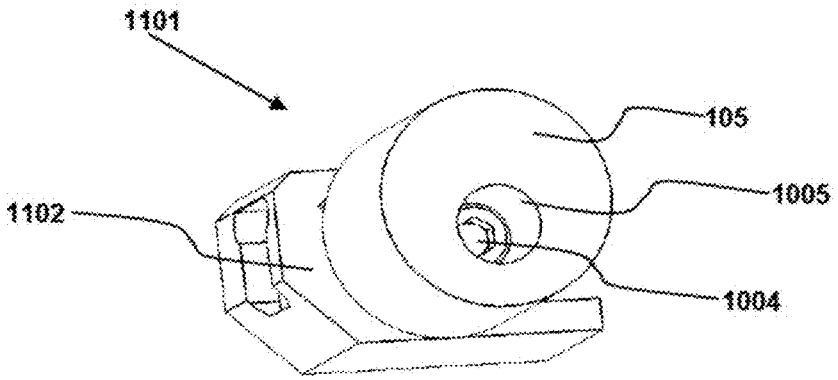
FIG. 10 illustrates a forward mount assembly in accordance with aspects of the embodiments.
Figure 11:
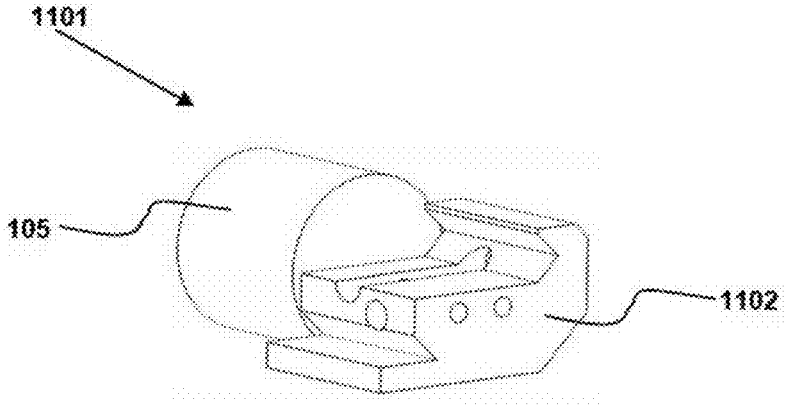
FIG. 11 illustrates a forward mount assembly in accordance with aspects of the embodiments.

FIGS. 10-11 illustrate a forward mount body 1101 in accordance with aspects of the embodiments. Round piece 105 is bolted to rear clamp body 1102 by a bolt 1004 sunk into hole 1005. The round piece 105 can be integrally formed with the forward clamp body 1102, but is illustrated as bolted on because it may be desirable to provide differently sized round pieces to adjust for differently sized attachment bores in bayonets. It can be seen from the figures that the clamping elements of forward clamp 107 and those of rear clamp 110 can be substantially similar with similar nut recesses, bolt grooves, and jaw grooves such that clamp jaw 701 can be used with forward mount 107.

Figure 12:
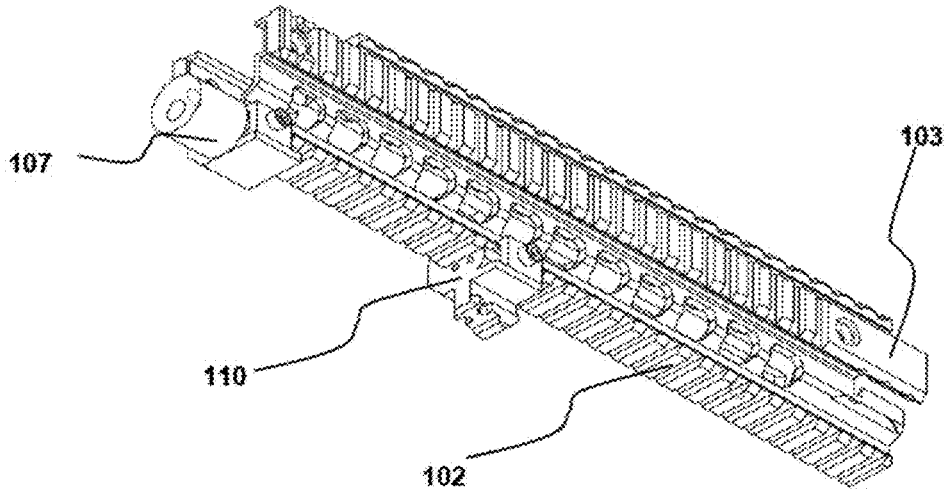
FIG. 12 illustrates a forward mount and a rear mount installed on a mounting rail in accordance with aspects of the embodiments.

FIG. 12 illustrates a forward mount 107 and a rear mount 110 installed on a mounting rail 102 in accordance with aspects of the embodiments. The mounting rail 102 is the lowest rail on a forward grip 103.

Figure 13:
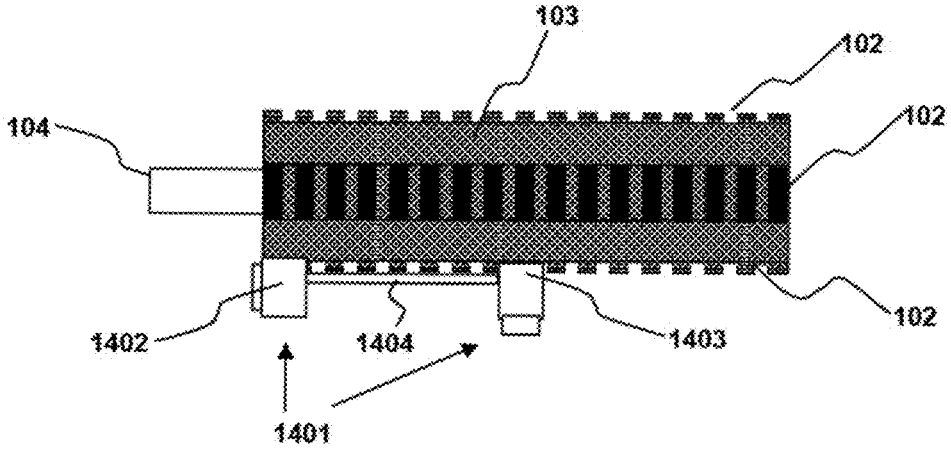
FIG. 13 illustrates a bayonet mounting fixture attached to the mounting rail of a firearm in accordance with aspects of the embodiments.
Figure 14:
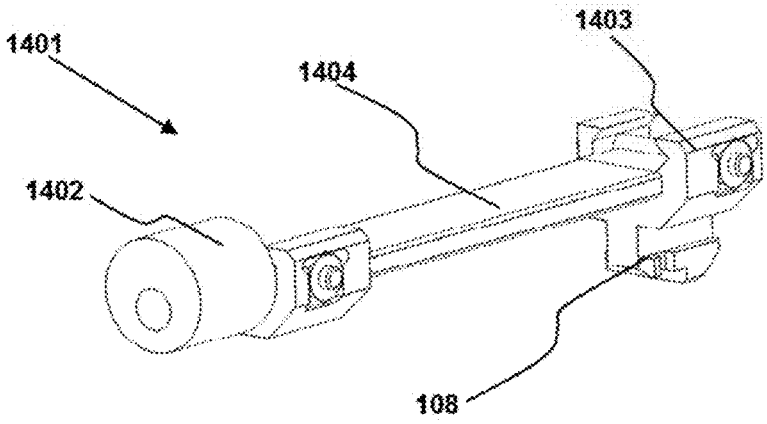
FIG. 14 illustrates a bayonet mounting fixture in accordance with aspects of the embodiments.
Figure 15:
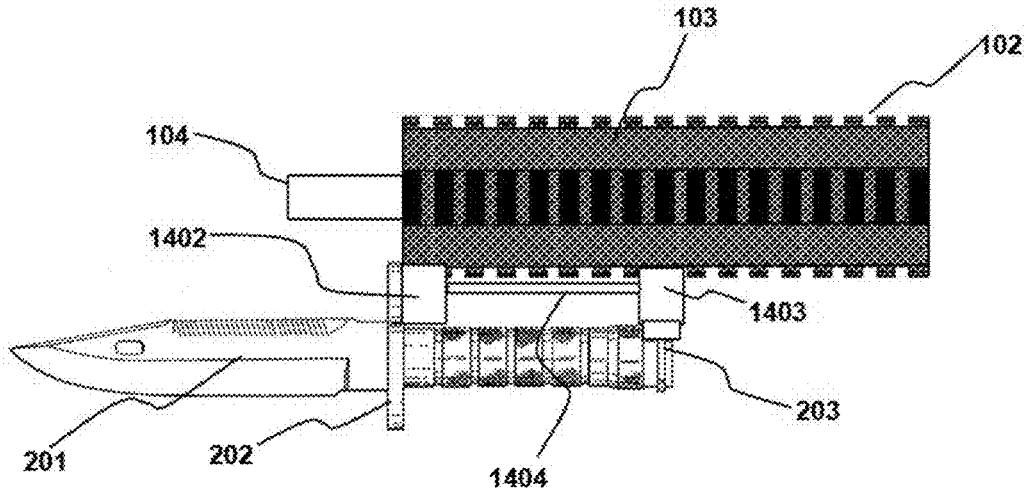
FIG. 15 illustrates a bayonet attached to a bayonet mounting fixture that is attached to the mounting rail of a firearm in accordance with aspects of the embodiments.
Figure 16:
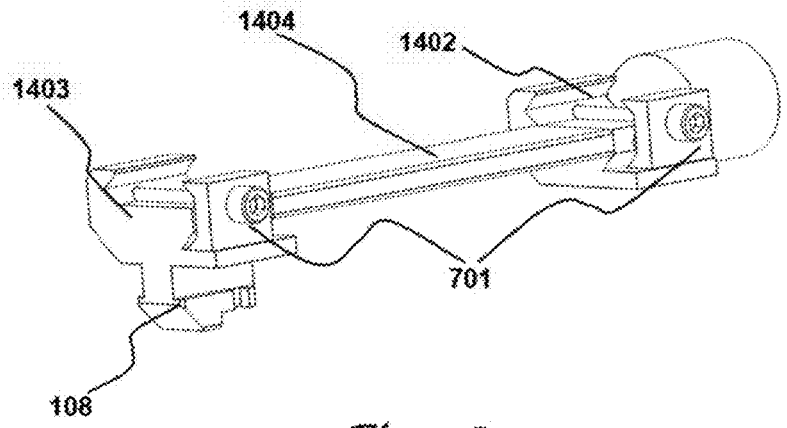
FIG. 16 illustrates a bayonet mounting fixture in accordance with aspects of the embodiments.

FIG. 13 illustrates a bayonet mounting fixture 1401 attached to the mounting rail 102 of a firearm 104 in accordance with aspects of the embodiments. Forward mount 1402 and rear mount 1403 are attached to one another by bridge 1404. FIGS. 14 and 16 provide a closer view of bayonet mounting fixture 1401 where it can be seen that forward mount 1402 is substantially similar to forward mount 107 and that rear mount 1403 is substantially similar to rear mount 110. FIG. 15 illustrates the bayonet of FIG. 2 attached to bayonet mounting fixture 1401 of FIGS. 13-14.

Figure 17:
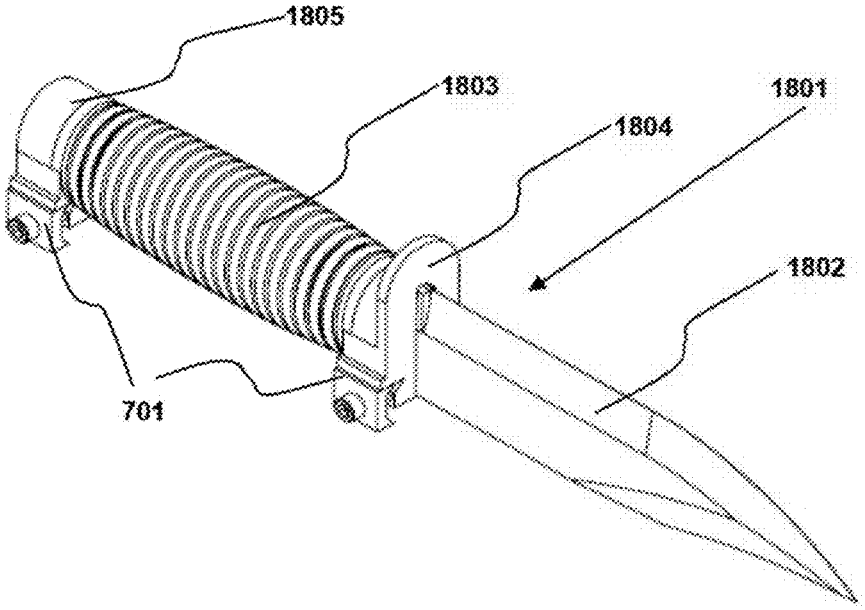
FIG. 17 illustrates a bayonet with Picatinny mounts in accordance with aspects of the embodiments.
Figure 18:
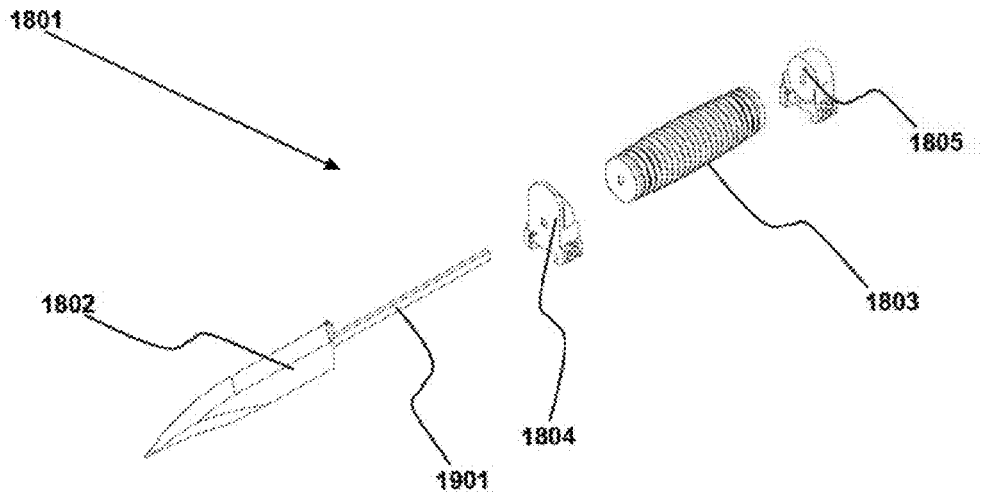
FIG. 18 illustrates an exploded view of a bayonet with Picatinny mounts in accordance with aspects of the embodiments.

FIGS. 17-18 illustrate a bayonet 1801 with Picatinny mounts in accordance with aspects of the embodiments. The bayonet 1801 has a blade 1802, handle 1803, hand guard 1804, and butt plate 1805. The hand guard 1804 and butt plate 1805 incorporate clamping mechanisms similar to those illustrated in FIGS. 3-11. A tang 1901 is illustrated as passing the full length of handle 1803, those practiced in the art of weaponry know this is a "full tang" embodiment. Without loss of generality, a shorter tang that ends within the handle can be used instead.

Figure 19:
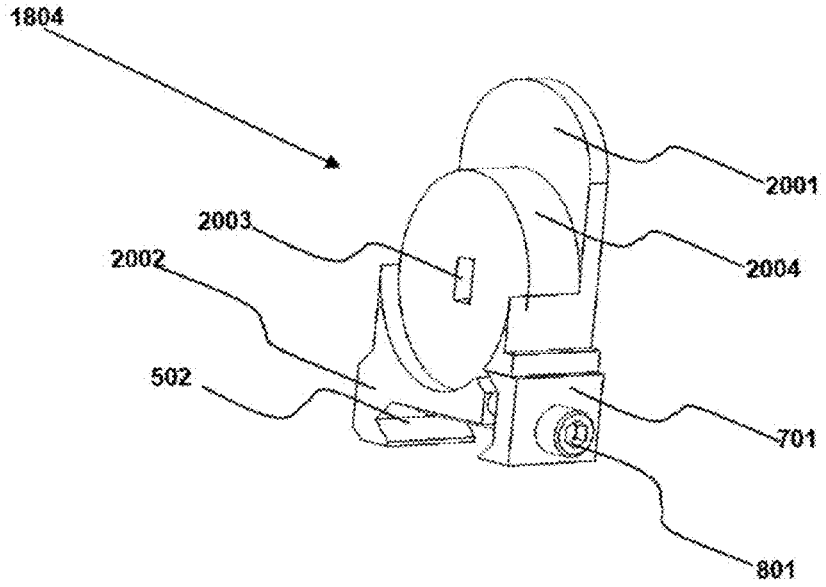
FIG. 19 illustrates a guard of a bayonet with Picatinny mounts in accordance with aspects of the embodiments.
Figure 20:
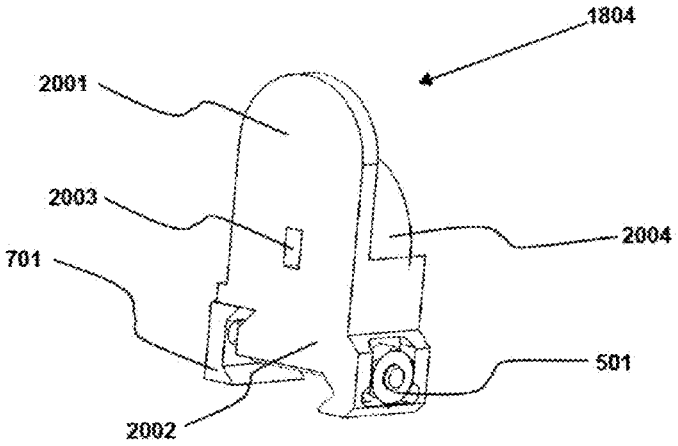
FIG. 20 illustrates a guard of a bayonet with Picatinny mounts in accordance with aspects of the embodiments.

FIGS. 19-20 illustrate a guard 1804 of a bayonet 1801 with Picatinny mounts in accordance with aspects of the embodiments. Guard clamp body 2002 is similar to the clamp bodies of FIGS. 3-11 with similar rail groove 502, nut recesses, bolt grooves, and jaw grooves such that tightening bolt 801 causes guard 1804 to clamp onto a mounting railed. Tang 1901 can pass through tang hole 2003 and into handle 1803. Handle interface 2004 provides for a smooth transition from handle 1803 to quillon 2001.

Figure 21:
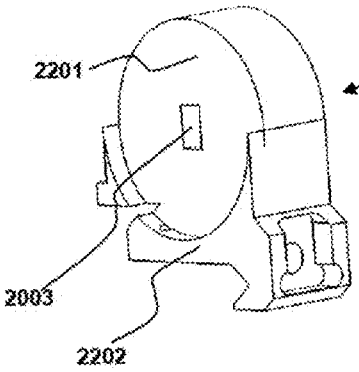
FIG. 21 illustrates a butt plate of a bayonet with Picatinny mounts in accordance with aspects of the embodiments.
Figure 22:
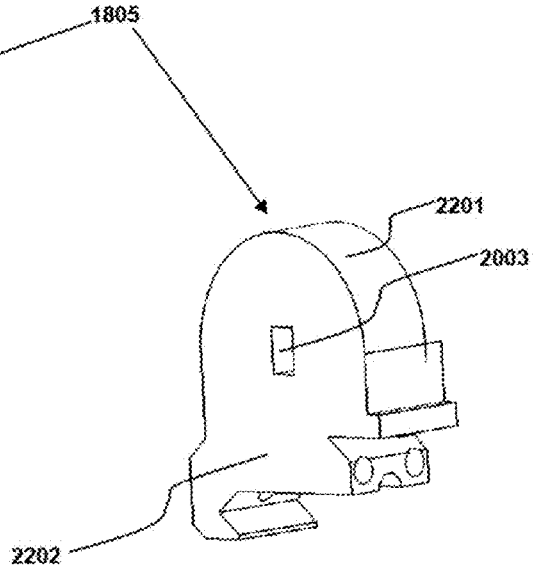
FIG. 22 illustrates a butt plate of a bayonet with Picatinny mounts in accordance with aspects of the embodiments.

FIGS. 21-22 illustrate a butt plate 1805 of a bayonet 1801 with Picatinny mounts in accordance with aspects of the embodiments. Butt clamp body 2202 is similar to the clamp bodies of FIGS. 3-11 with similar rail groove 502, nut recesses, bolt grooves, and jaw grooves such that tightening bolt 801 causes butt plate 1805 to clamp onto a mounting railed. Tang 1901 can pass through tang hole 2003 from handle 1803 and pinned or otherwise fixed in place to thereby assemble the bayonet. Those skilled in the art of weaponry know other techniques for assembling partial tang and full tang knives or bayonets. Butt interface 2201 provides for a smooth transition from handle 1803 to butt plate 1805.

Figure 23:
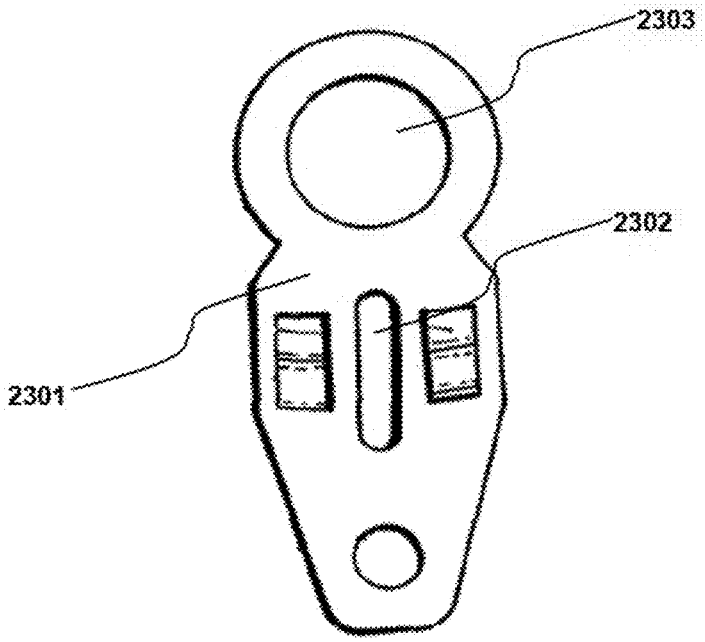
Fig. 23 (Prior Art)
FIG. 23, labeled as "Prior Art" illustrates a bayonet guard of a bayonet.

FIG. 23, labeled as "Prior Art," illustrates a bayonet guard 2301 of a prior art bayonet. FIG. 23 is taken from FIG. 5 of U.S. Pat. No. 5,594,967 which has been included herein by reference and is intended to illustrate the attachment bore 2303 of bayonets that can be attached to bayonet mounting fixtures 101 and 1401. The illustrated bayonet guard 2301 has a tang hole 2302 similar to tang hole 2003 of guard 1804.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A system for attaching an M9 bayonet to a firearm, wherein the firearm comprises a mounting rail, wherein the M9 bayonet comprises an attachment bore and a latching mechanism, the system comprising:

a bayonet mounting fixture, wherein the bayonet mounting fixture comprises a forward mount, a rear bolt, and a rear mount;

wherein the forward mount comprises a forward clamp and a round piece fixed to the forward clamp wherein the forward clamp is configured to clamp onto the mounting rail;

wherein the rear mount comprises a rear clamp and a mounting lug fixed to the rear clamp, wherein the rear clamp is configured to clamp onto the mounting rail, wherein the rear clamp comprises a rear clamp body and a rear jaw, wherein the rear clamp body is fixed to the mounting lug, wherein the rear clamp body and the rear jaw are configured to tighten onto the mounting rail so as to cause the rear clamp to clamp onto the mounting rail;

wherein the rear bolt passes through the rear jaw and into the rear clamp body, and wherein the rear bolt is configured to be tightened so as to cause the rear clamp to clamp onto the mounting rail, thereby providing for attachment of the M9 bayonet; and wherein the round piece is configured to rigidly and removably fit into the attachment bore, and wherein the mounting lug is configured to rigidly and removably attach to the latching mechanism to thereby attach the M9 bayonet to the firearm.

2. The system of claim 1 wherein the forward clamp comprises a forward clamp body and a forward jaw, wherein the forward clamp body is fixed to the round piece, wherein the forward clamp body and the forward jaw are configured to tighten onto the mounting rail so as to cause the forward clamp to clamp onto the mounting rail.

3. The system of claim 1 further comprising a forward bolt, wherein the forward bolt passes through the forward jaw and into the forward clamp body, and wherein the forward bolt is configured to be tightened so as to cause the forward clamp to clamp onto the mounting rail.

4. The system of claim 3 wherein the mounting rail is a Picatinny rail having a plurality of recoil grooves and wherein the forward bolt is configured to pass through one of the recoil grooves to prevent the forward clamp from sliding along the Picatinny rail.

5. The system of claim 4 wherein the rear bolt is configured to pass through another one of the recoil grooves to prevent the rear clamp from sliding along the Picatinny rail.

6. The system of claim 5 further comprising a bridge fixed to the forward clamp body and the rear clamp body.

7. The system of claim 6 further comprising the M9 bayonet.

8. The system of claim 1 further comprising a bridge fixed to the forward clamp and the rear clamp.

9. The system of claim 8 wherein the bridge is configured to engage the mounting rail and prevents the bridge from pulling away from the mounting rail.

10. A method for attaching a an M9 bayonet to a firearm, the method comprising:

attaching a forward mount to a mounting rail, wherein the firearm comprises the mounting rail, and wherein the forward mount comprises a round piece;

attaching a rear mount to the mounting rail, wherein the rear mount comprises a mounting lug, a rear clamp, and a rear bolt, wherein the rear clamp comprises a rear clamp body and a rear jaw, wherein the rear clamp is clamped onto the mounting rail, wherein the rear clamp body is fixed to the mounting lug, wherein tightening the rear clamp body and the rear jaw onto the mounting rail causes the rear clamp to clamp onto the mounting rail, wherein the rear bolt passes through the rear jaw and into the rear clamp body, and wherein the rear bolt is tightened to attach the rear mount to the mounting rail; and attaching the M9 bayonet to the forward mount and to the rear mount, wherein the bayonet comprises an attachment bore and a latching mechanism, wherein the round piece fits into the attachment bore, and wherein the latching mechanism is removably attached to the mounting lug.

11. The method of claim 10 wherein the forward mount further comprises a front clamp wherein the front clamp is clamped onto the mounting rail.

12. The method of claim 11 wherein the front clamp comprises a front clamp body and a front jaw, wherein the front clamp body is fixed to the round piece, wherein tightening the front clamp body and the front jaw onto the mounting rail causes front clamp to clamp onto the mounting rail.

13. The method of claim 12, the forward mount further comprising a front bolt, wherein the front bolt passes through the front jaw and into the front clamp body, and wherein the front bolt is tightened to attach the forward mount to the mounting rail.

14. The method of claim 10 further comprising engaging a bridge with the rail to prevent the bridge from pulling away from the rail wherein the bridge is fixedly attached to the forward mount and to the rear mount.

15. A system comprising:

an M9 bayonet comprising an attachment bore and a latching mechanism;

a bayonet mounting fixture for attaching the M9 bayonet to a firearm, wherein the firearm comprises a Picatinny rail, wherein the Picatinny rail is a mounting rail comprising a plurality of recoil grooves, and wherein the bayonet mounting fixture comprises a forward mount and a rear mount;

wherein the forward mount comprises a forward clamp and a round piece fixed to the forward clamp wherein the forward clamp clamps onto the Picatinny rail;

wherein the rear mount comprises a rear clamp and a mounting lug fixed to the rear clamp, wherein the rear clamp clamps onto the Picatinny rail;

a bridge fixedly attached to the forward clamp body and the rear clamp body;

wherein the M9 bayonet attaches to the bayonet mounting fixture, wherein the round piece fits into the attachment bore, and wherein the latching mechanism is removably fixed to the mounting lug;

wherein the forward clamp comprises a forward clamp body, a forward jaw, and a forward bolt, wherein the forward bolt passes through the forward jaw and into the forward clamp body, wherein tightening the forward bolt causes the forward jaw and the forward clamp body to clamp onto the Picatinny rail, and wherein the forward bolt passes through one of the recoil grooves to prevent the forward clamp from sliding along the Picatinny rail; and wherein the rear clamp comprises a rear clamp body, a rear jaw, and a rear bolt, wherein the rear bolt passes through the rear jaw and into the rear clamp body, wherein tightening the rear bolt causes the rear jaw and the rear clamp body to clamp onto the Picatinny rail, and wherein the rear bolt passes through another one of the recoil grooves to prevent the rear clamp from sliding along the Picatinny rail.

* * * * *